US010485394B2

(12) United States Patent
Hu et al.

(10) Patent No.: US 10,485,394 B2
(45) Date of Patent: Nov. 26, 2019

(54) DUST COLLECTION BOX AND ROBOT VACUUM CLEANER

(71) Applicants: JIANGSU MIDEA CLEANING APPLIANCES CO., LTD., Suzhou (CN); MIDEA GROUP CO., LTD., Foshan (CN)

(72) Inventors: Wei Hu, Suzhou (CN); Xianmin Wei, Suzhou (CN); Manzhi Jin, Suzhou (CN)

( * ) Notice: Subject to any disclaimer, the term of this patent is extended or adjusted under 35 U.S.C. 154(b) by 0 days.

(21) Appl. No.: 16/128,542

(22) Filed: Sep. 12, 2018

(65) Prior Publication Data

US 2019/0298131 A1 Oct. 3, 2019

Related U.S. Application Data

(63) Continuation of application No. PCT/CN2018/098033, filed on Aug. 1, 2018.

(30) Foreign Application Priority Data

Mar. 30, 2018 (CN) ..... 2018 2 0465699 U

(51) Int. Cl.
*A47L 5/00* (2006.01)
*A47L 9/04* (2006.01)
(Continued)

(52) U.S. Cl.
CPC ..... *A47L 9/1683* (2013.01); *A47L 9/149* (2013.01); *A47L 9/1445* (2013.01); *A47L 2201/00* (2013.01)

(58) Field of Classification Search
CPC ..... A47L 5/00; A47L 9/04; A47L 9/10; A47L 9/1427; A47L 9/1472; A47L 2201/00;
(Continued)

(56) References Cited

U.S. PATENT DOCUMENTS 5,102,435 A 4/1992 Rau et al.
7,749,294 B2 * 7/2010 Oh ..... A47L 5/28 15/319

(Continued)

FOREIGN PATENT DOCUMENTS

CN 201256923 Y 6/2009
CN 201328771 Y 10/2009

(Continued)

*Primary Examiner* — Minh Chau T Pham
(74) *Attorney, Agent, or Firm* — Kilpatrick Townsend & Stockton

(57) ABSTRACT

A dust collection box and a robot vacuum cleaner are disclosed. The dust collection box includes a box body, a first lid detachably arranged to the box body, a filter, and a filter missing-alert device arranged to the first lid. The filter missing-alert device includes a movable member. When the filter is not mounted into the box body and the first lid is arranged to be closed on to the box body, the movable member interferes with the box body, such that the box body cannot be closed with the first lid. When the filter is mounted into the box body and the first lid is arranged to the box body, the filter missing-alert device interferes with the filter to eliminate the interference between the movable member and the box body, such that the box body can be closed with the first lid.

16 Claims, 10 Drawing Sheets

(51) Int. Cl.

| | |
|---|---|
| ***A47L 9/10*** | (2006.01) |
| ***B01D 45/00*** | (2006.01) |
| ***A47L 9/16*** | (2006.01) |
| ***A47L 9/14*** | (2006.01) |

(58) Field of Classification Search
CPC ..... A47L 9/1683; A47L 9/149; A47L 9/1445; B01D 45/00
USPC ..... 55/356, 357, 385.1, 429, 467, 459.1, 55/DIG. 3; 15/319, 347, 353
See application file for complete search history.

(56) References Cited

U.S. PATENT DOCUMENTS

| | | | | |
|---|---|---|---|---|
| 2007/0039293 | A1* | 2/2007 | Baek | A47L 9/1472 55/354 |
| 2007/0137153 | A1* | 6/2007 | Oh | A47L 5/28 55/385.1 |
| 2011/0126375 | A1* | 6/2011 | Yan | A47L 9/19 15/319 |
| 2012/0095597 | A1* | 4/2012 | Kim | A47L 5/28 700/259 |

FOREIGN PATENT DOCUMENTS

| | | | | |
|---|---|---|---|---|
| CN | 202981884 | U | 6/2013 | |
| CN | 203943625 | U | 11/2014 | |
| CN | 203987867 | U | 12/2014 | |
| CN | 204105894 | U | 1/2015 | |
| CN | 205729246 | U | 11/2016 | |
| EP | 2636351 | A1 * | 9/2013 | A47L 9/1427 |
| RU | 2013110331 | * | 9/2014 | A47L 9/04 |

* cited by examiner

DUST COLLECTION BOX AND ROBOT VACUUM CLEANER

PRIORITY

This application is a continuation of International Application No. PCT/CN2018/098033, filed on Aug. 1, 2018, which claims priority to and the benefit of Chinese Patent Application No. 201820465699.2 filed in the China's State Intellectual Property Office on Mar. 30, 2018, the entire contents of which are incorporated herein by reference.

FIELD

The present disclosure relates to a technical field of household appliances, and more particularly to a dust collection box and a robot vacuum cleaner.

BACKGROUND

In an existing robot vacuum cleaner, a filter is usually mounted in a movable manner, that is, the filter can be removed from a dust collection box of the robot vacuum cleaner to be conveniently replaced by a user. However, in actual use, many users often forget to assemble the filter into the dust collection box out of carelessness. When the dust collection box without the filter is mounted to the robot vacuum cleaner, air without being filtered is directly sucked into an electric motor, and most dust is discharged along with the air, causing secondary pollution. In addition, the dust sucked into the electric motor may affect the service life of the electric motor.

SUMMARY

Embodiments of the present disclosure provide a dust collection box and a robot vacuum cleaner.

The dust collection box according to embodiments of the present disclosure includes a box body, a first lid detachably arranged to the box body, a filter, and a filter missing-alert device arranged to the first lid, the filter missing-alert device including a movable member. When the filter is not mounted into the box body and the first lid is arranged to the box body, the movable member interferes with the box body, such that the box body cannot be closed with the first lid. When the filter is mounted into the box body and the first lid is arranged to the box body, the filter missing-alert device interferes with the filter to eliminate the interference between the movable member and the box body, such that the box body can be closed with the first lid.

For the dust collection box according to embodiments of the present disclosure, when the filter is not mounted in the box body, the box body cannot be closed with the first lid by using the filter missing-alert device. In this way, it is possible to effectively prevent a user from forgetting to assemble the filter, hence prevent the air from being discharged without filtration, and also prevent the dust from affecting the service life of the electric motor.

The robot vacuum cleaner according to embodiments of the present disclosure includes a robot body; and a dust collection box, arranged to the robot body, and including a box body, a first lid detachably arranged to the box body, a filter, and a filter missing-alert device arranged to the first lid, the filter missing-alert device including a movable member. When the filter is not mounted into the box body and the first lid is arranged to the box body, the movable member interferes with the box body, such that the box body cannot be closed with the first lid. When the filter is mounted into the box body and the first lid is arranged to the box body, the filter missing-alert device interferes with the filter to eliminate the interference between the movable member and the box body, such that the box body can be closed with the first lid.

For the robot vacuum cleaner according to embodiments of the present disclosure, when the filter is not mounted in the box body, the box body cannot be closed with the first lid by using the filter missing-alert device. In this way, it is possible to effectively prevent the user from forgetting to assemble the filter, hence prevent the air from being discharged without filtration, and also prevent the dust from affecting the service life of the electric motor.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which.

Figure 1:
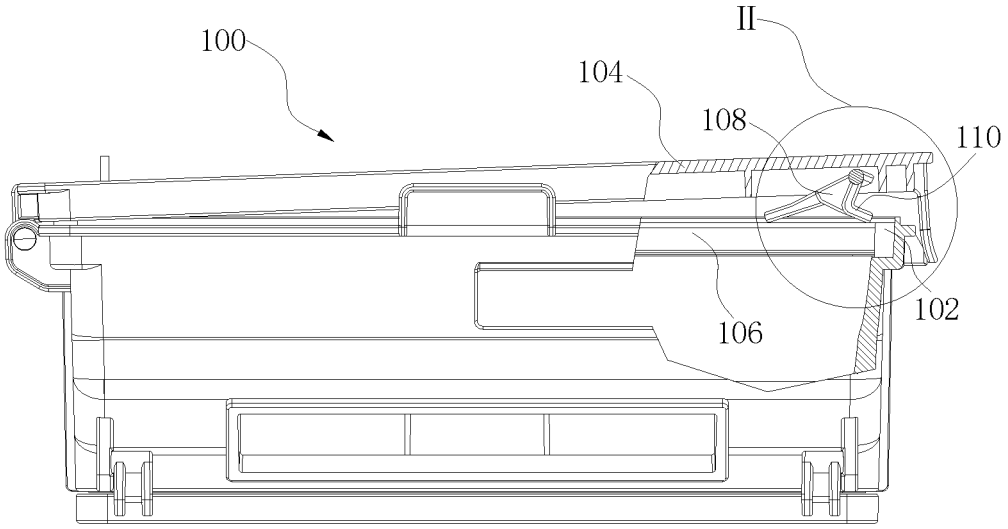
FIG. 1 is a partial sectional view of a movable member and a box body free of mutual interference according to an embodiment of the present disclosure.

MAIN REFERENCE NUMERALS dust collection box 100, box body 102, first lid 104, filter 106, filter missing-alert device 108, movable member 110, rotating part 112, driving member 114, connecting part 116, mounting structure 118, mounting hole 120, first rotating shaft 122, first elastic member 124, filter holder 126, separation structure 128, air inlet 130, air outlet 132, opening 134, bottom plate 136, lateral plate 138, accommodating space 140, inclined surface 142, support plate 144, dust extraction port 146, second lid 148, first lateral portion 150, second lateral portion 152, snap structure 154, button 156, second rotating shaft 158, hook 160, snapping part 162, snapping surface 164, snapping bar 166, press board 168, first swing end 170, second swing end 172, second elastic member 174, sealing member 176, robot vacuum cleaner 1000, robot body 200.

DETAILED DESCRIPTION

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure have a particular orientation or be constructed or operated in a particular orientation. Thus, these terms cannot be constructed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the description of the present disclosure, it should be understood that, unless specified or limited otherwise, the terms "mounted," "connected," and "coupled" and variations thereof are used broadly and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

Referring to FIGS. 1-5, a dust collection box 100 according to the present disclosure includes a box body 102, a first lid 104 detachably arranged to the box body 102, a filter 106, and a filter missing-alert device 108 arranged to the first lid 104. The filter missing-alert device 108 includes a movable member 110. When the filter 106 is not mounted into the box body 102 and the first lid 104 is however arranged to closed onto box body 102, the movable member 110 interferes with the box body 102, such that the box body 102 cannot be closed with the first lid 104. When the filter 106 is mounted into the box body 102 and the first lid 104 is arranged to the box body 102, the filter missing-alert device 108 interferes with the filter 106 to eliminate the interference between the movable member 110 and the box body 102, such that the box body 102 can be closed with the first lid 104.

For the dust collection box 100 according to embodiments, when the filter 106 is not mounted in the box body 102, and the box body 102 cannot be closed with the first lid 104 by using the filter missing-alert device 108. In this way, it is possible to effectively prevent a user from closing the first lid 104 without mounting the filter 106 into the box body 102, hence prevent the air from being discharged without filtration, and also prevent the dust from affecting the service life of the electric motor.

It could be understood that the dust collection box 100 is usually provided with the filter 106 within the box body 102 to filter out dust. The interference between the movable member 110 of the filter missing-alert device 108 and the box body 102 can be used to prevent the user from forgetting to assemble the filter 106. When the filter 106 is not mounted into the box body 102 and the first lid 104 is arranged to be closed onto the box body 102, the movable member 110 interferes with the box body 102, and the box body 102 cannot be closed with the first lid 104 successfully. When the filter 106 is mounted into the box body 102 and the first lid 104 is arranged to the box body 102, the filter missing-alert device 108 interferes with the filter 106 to eliminate the interference between the movable member 110 and the box body 102, such that the box body 102 can be closed with the first lid 104 successfully. The interference between the movable member 110 and the box body 102 can be eliminated through rotation or extension/retraction of the movable member 110. For example, when the interference between the movable member 110 and the box body 102 is eliminated by the extension/retraction, the filter missing-alert device 108 can include a pressure-resistant assembly that includes a pressure-resistant part and a retractable movable member 110, the movable member may be configured as a snap block, and the pressure-resistant part is connected with the movable member. When the filter 106 is not mounted into the box body 102 and the first lid 104 is arranged to the box body 102, the movable member is held on an upper edge of the box body 102, and the box body 102 cannot be closed with the first lid 104 successfully. When the filter 106 is mounted into the box body 102 and the first lid 104 is arranged to the box body 102, the pressure-resistant part is in contact with the filter 106 and becomes stressed, so as to drive the movable member to retract to enable the snap block to be disengaged from the box body 102, in which way the box body 102 can be closed with the first lid 104 successfully.

An embodiment of eliminating the interference between the movable member 110 and the box body 102 through rotation is described below.

Referring to FIGS. 1-7, in this embodiment, the filter missing-alert device 108 includes a rotating part 112 rotatably connected with the first lid 104. The rotating part 112 includes a movable member 110 and a driving member 114. When the filter 106 is not mounted into the box body 102 and the first lid 104 is arranged to be closed onto the box body 102, a tail end of the driving member 114 is suspended and stretches into the box body 102. When the filter 106 is mounted into the box body 102 and the first lid 104 is arranged to the box body 102, the tail end of the driving member 114 interferences with the filter 106, such that the driving member 114 drives the rotating part 112 to rotate to eliminate the interference between the movable member 110 and the box body 102.

Figure 2:
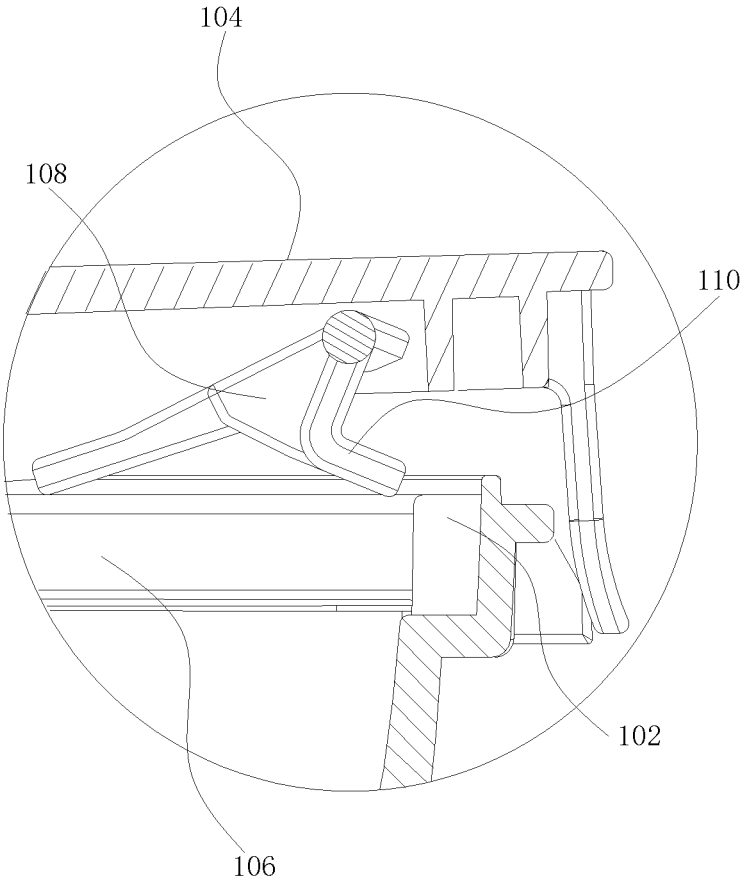
FIG. 2 is an enlarged view of part II in FIG. 1.
Figure 3:
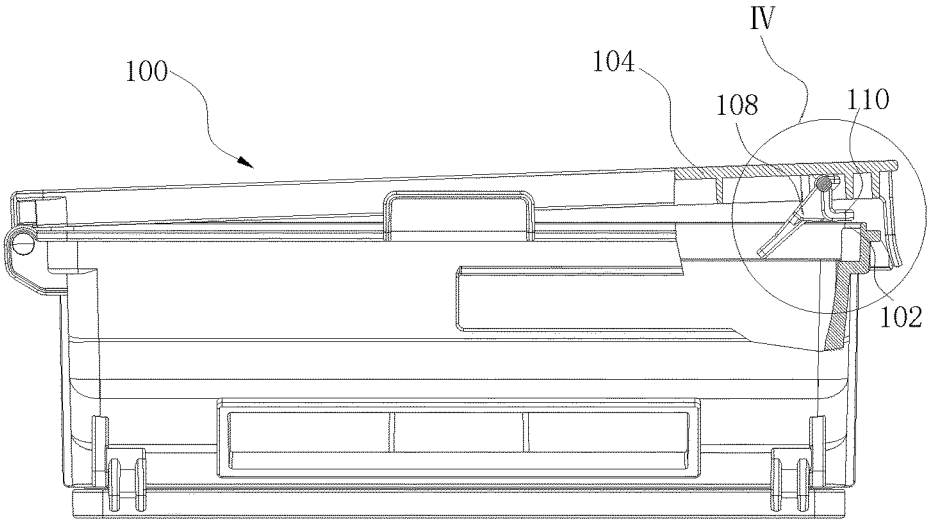
FIG. 3 is a partial sectional view of a movable member and a box body subjected to mutual interference according to an embodiment of the present disclosure.
Figure 4:
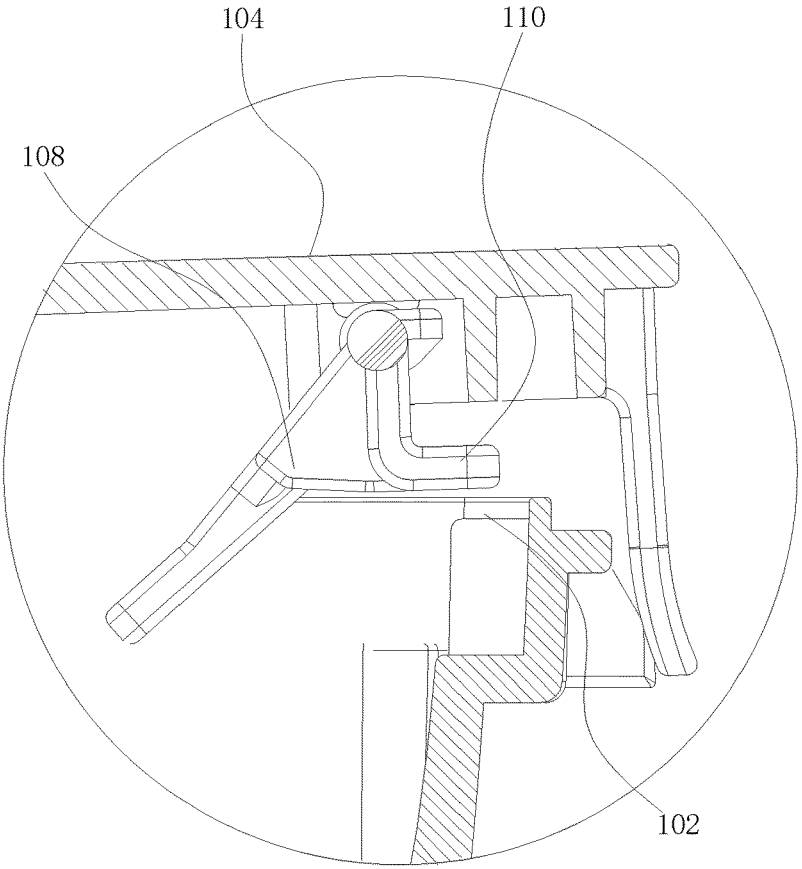
FIG. 4 is an enlarged view of part IV in FIG. 3.
Figure 5:
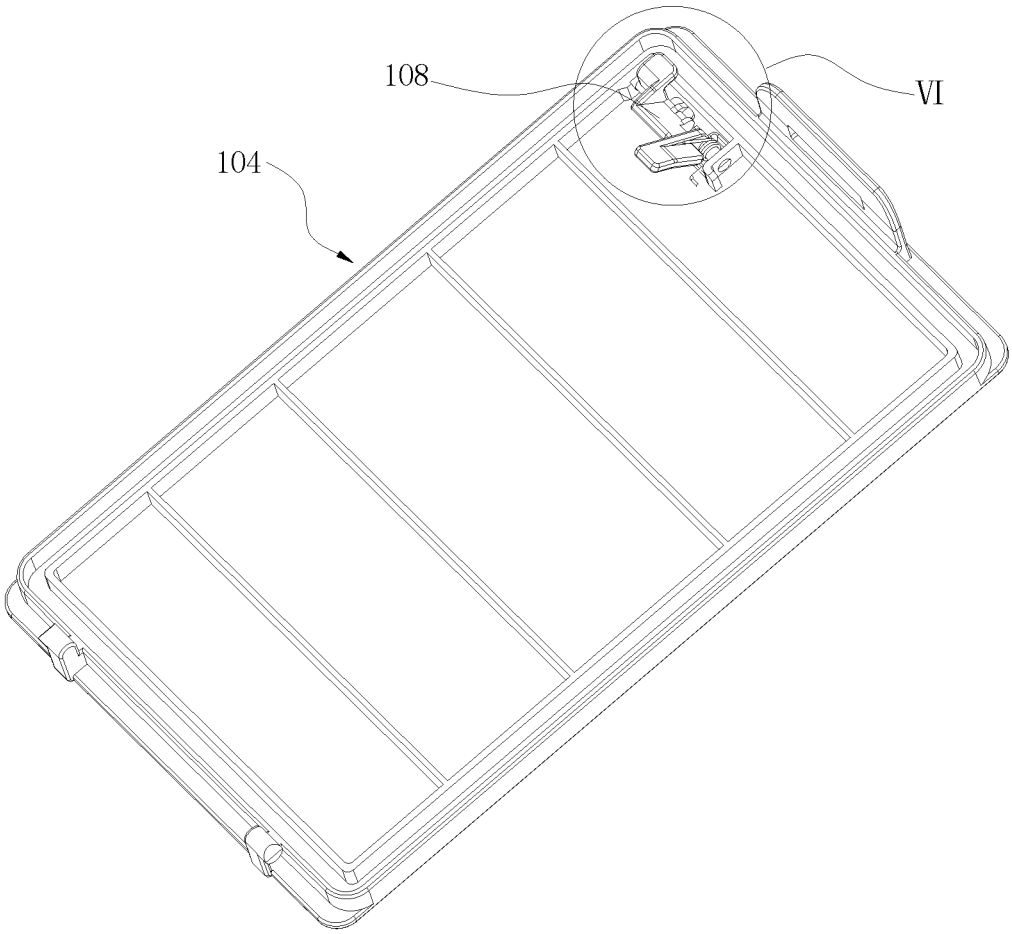
FIG. 5 is a perspective view of a first lid according to an embodiment of the present disclosure.

It could be understood that the filter missing-alert device 108 is arranged to the first lid 104. When the filter 106 is not mounted into the box body 102 and the first lid 104 is arranged to the box body 102, the tail end of the driving member 114 is suspended and stretches into the box body 102, in which case the driving member 114 is unstressed and the movable member 110 abuts against the upper edge of the box body 102. That is the movable member 110 interferes with the box body 102, so that the box body 102 cannot be closed with the first lid 104 successfully. When the filter 106 is mounted into the box body 102 and the first lid 104 is arranged to the box body 102, the tail end of the driving member 114 is in contact with the filter 106 and becomes stressed, such that the driving member 114 drives the rotating part 112 to rotate to make the movable member 110 rotate clockwise as shown in FIGS. 1 and 2, in which case the interference between the movable member 110 and the box body 102 is eliminated, and the box body 102 can be closed with the first lid 104 successfully.

In this embodiment, the rotating part 112 includes a connecting part 116. The driving member 114 and the movable member 110 are connected at two sides of the connecting part 116. The connecting part 116 is rotatably connected with the first lid 104.

In such a way, it is possible to eliminate the interference between the movable member 110 and the box body 102 by the driving member 114 driving the rotating part 112 to rotate to make the movable member 110 disengaged from the box body 102.

Figure 6:
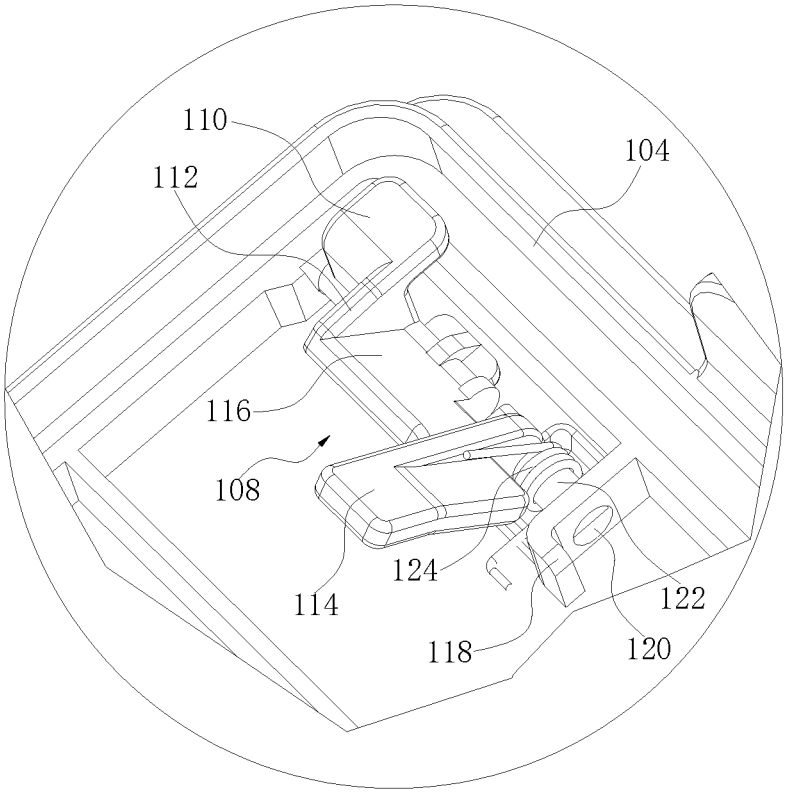
FIG. 6 is an enlarged view of part VI of the first lid in FIG. 5.
Figure 7:
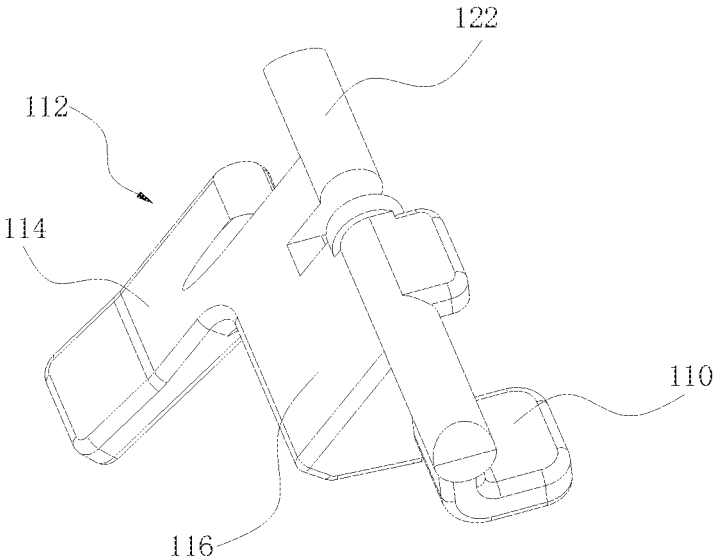
FIG. 7 is a perspective view of a rotating part according to an embodiment of the present disclosure.

Referring to FIG. 6, a bottom surface of the first lid 104 is provided with a mounting structure 118. The mounting structure 118 is provided with a mounting hole 120, the connecting part 116 includes a first rotating shaft 122, and the first rotating shaft 122 is rotatably arranged in the mounting hole 120, as illustrated in FIG. 6.

Thus, the rotating part 112 is rotatably connected to the first lid 104 through the fitting between the first rotating shaft 122 and the mounting hole 120.

In this embodiment, the filter missing-alert device 108 includes a first elastic member 124. The first elastic member 124 abuts the first lid 104 and the rotating part 112. The first elastic member 124 is configured to drive the movable member 110 to rotate when the driving member 114 interferes with the filter 106, so as to eliminate the interference between the movable member 110 and the box body 102.

It could be understood that the first elastic member 124 abuts the first lid 104 and the rotating part 112, and when the filter 106 is mounted into the box body 102 and the first lid 104 is arranged to the box body 102, the tail end of the driving member 114 is in contact with the filter 106 and becomes stressed, and the force acted on the driving member 114 is transmitted by the first elastic member 124 to rotate the movable member 110, such that the movable member 110 is able to be disengaged from the box body 102 and the interference between the movable member 110 and the box body 102 is eliminated. In some embodiments, the first elastic member 124 can be a torsion spring, the torsion spring is fitted over the first rotating shaft 122, and two ends of the torsion spring abut the first lid 104 and the driving member 114 respectively.

Figure 8:
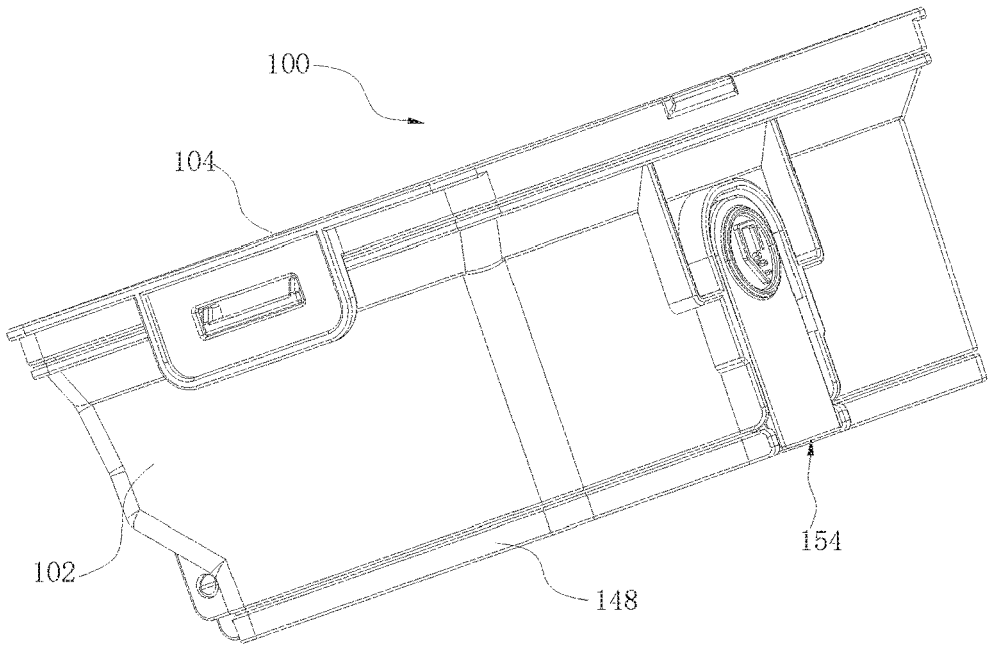
FIG. 8 is a perspective view of a dust collection box according to an embodiment of the present disclosure.
Figure 9:
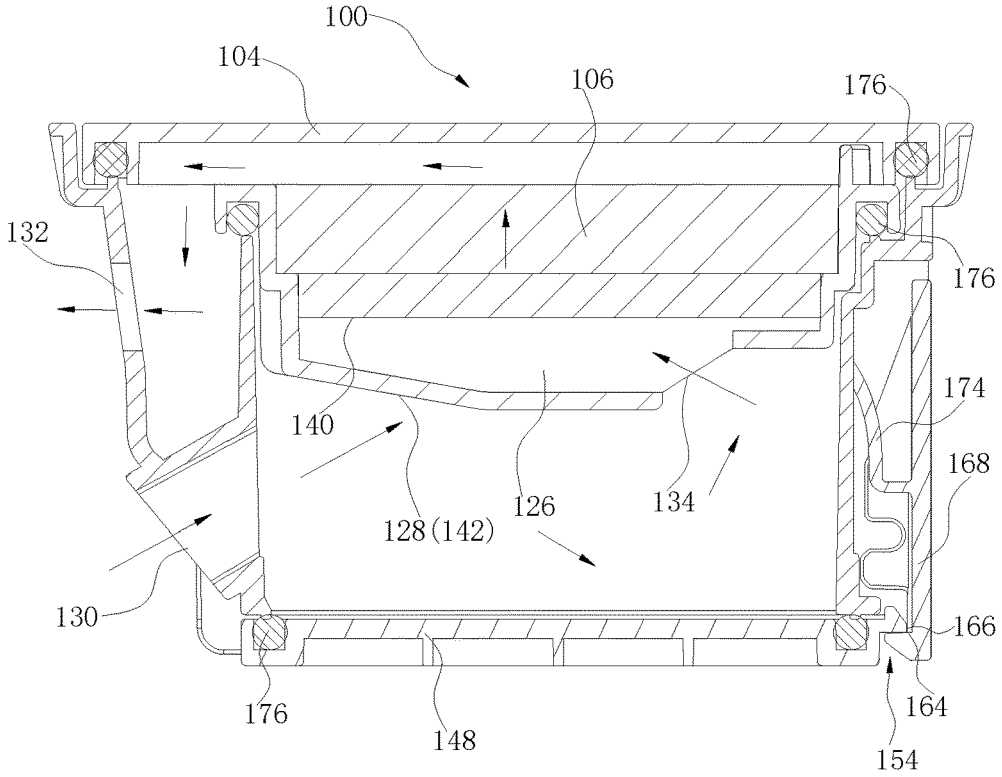
FIG. 9 is a sectional view of a dust collection box according to an embodiment of the present disclosure.
Figure 10:
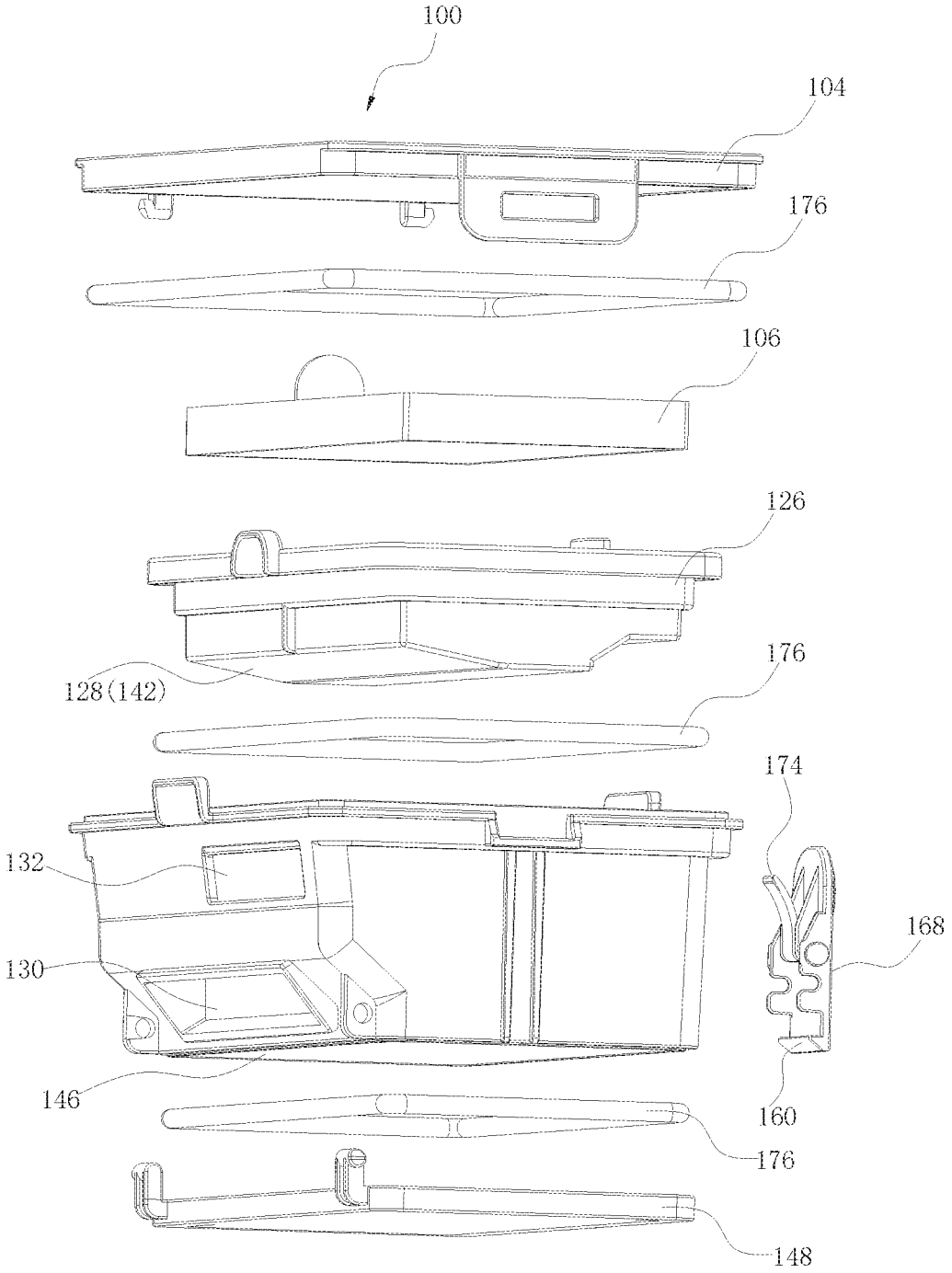
FIG. 10 is an exploded view of a dust collection box according to an embodiment of the present disclosure.
Figure 11:
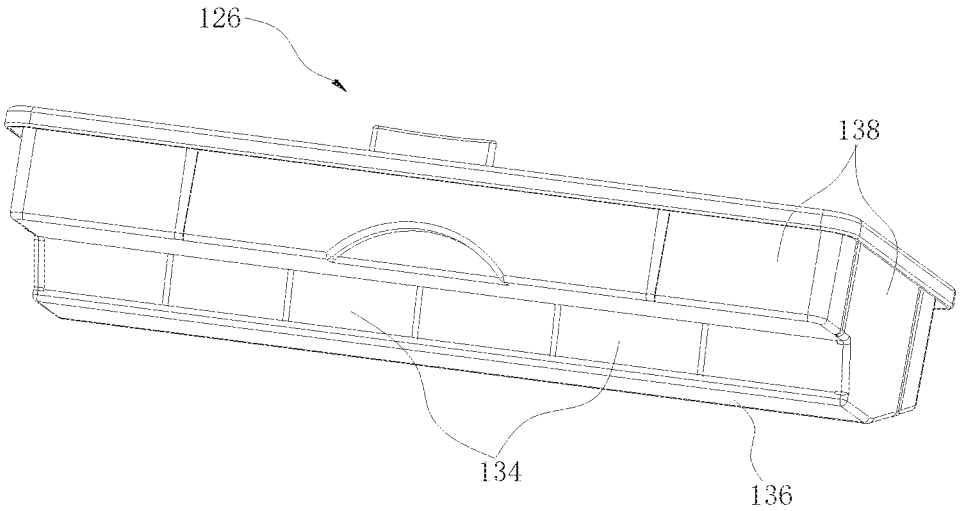
FIG. 11 is a perspective view of a filter holder according to an embodiment of the present disclosure.
Figure 12:
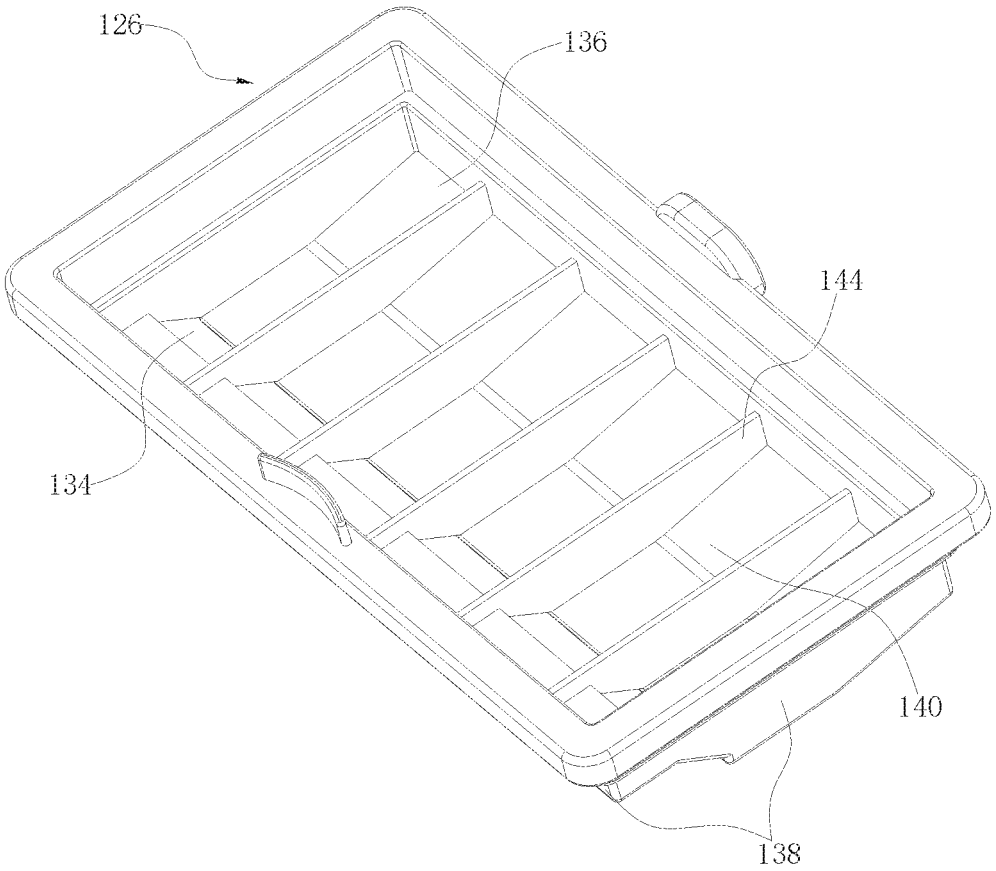
FIG. 12 is another perspective view of a filter holder according to an embodiment of the present disclosure.
Figure 13:
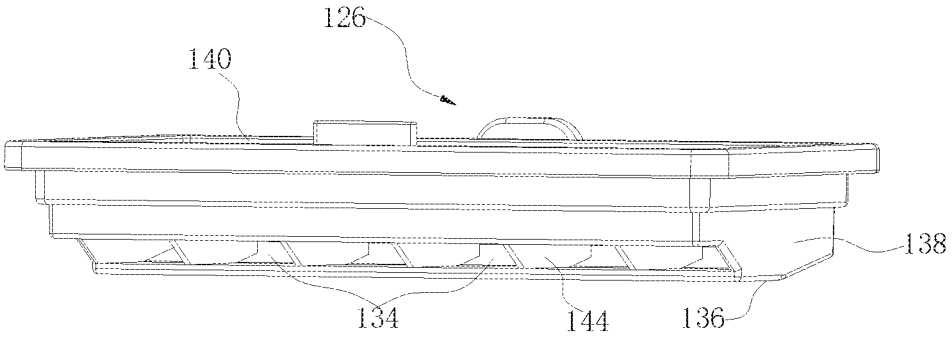
FIG. 13 is still another perspective view of a filter holder according to an embodiment of the present disclosure.
Figure 14:
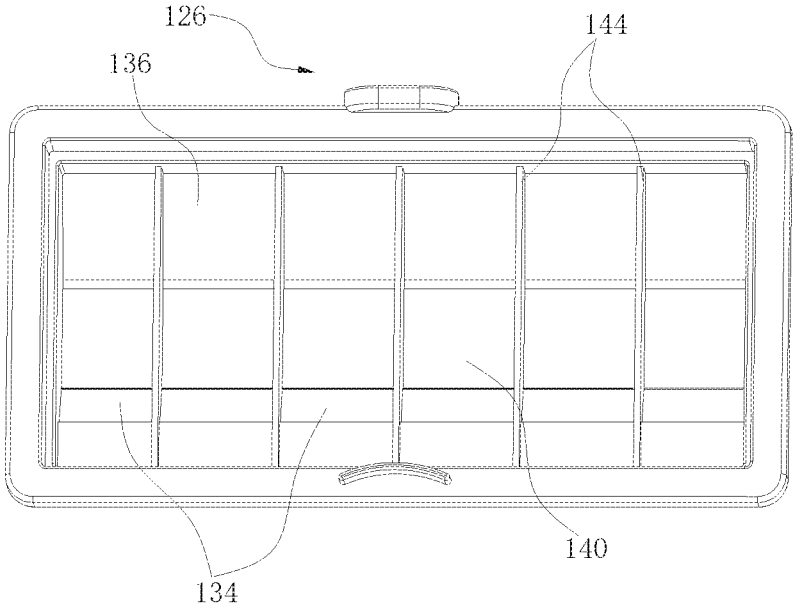
FIG. 14 is yet another perspective view of a filter holder according to an embodiment of the present disclosure.
Figure 15:
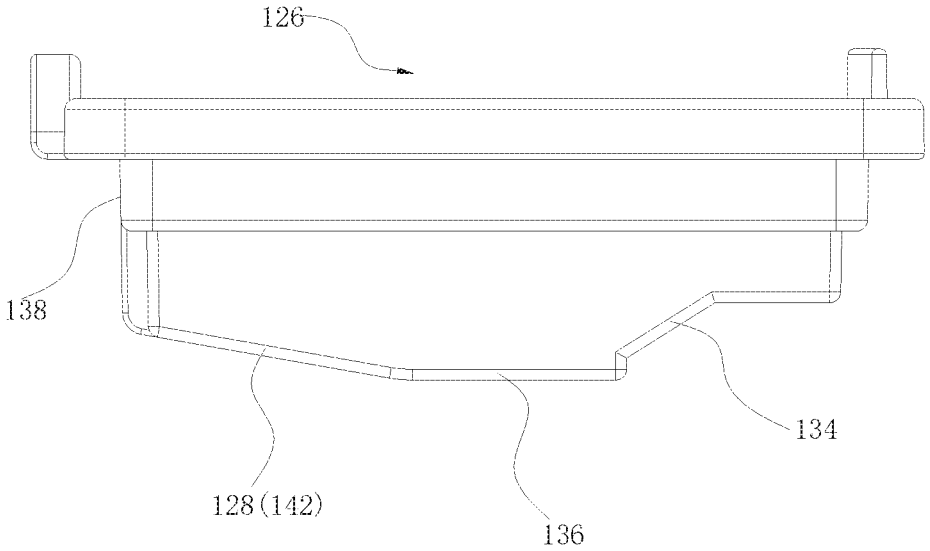
FIG. 15 is a side view of a filter holder according to an embodiment of the present disclosure.

Referring to FIGS. 8-10, in some embodiments, the dust collection box 100 includes a filter holder 126 arranged within the box body 102 and a separation structure 128 configured to block dust. The box body 102 defines an air inlet 130 and an air outlet 132. A lateral surface of the filter holder 126 defines an opening 134. The separation structure 128 is arranged within the box body 102 and located at an air inlet side of the opening 134. When the filter 106 is arranged in the box body 102, the filter 106 is arranged on the filter holder 126 and located at an air outlet side of the opening 134.

It could be understood that most of the dust can be blocked by the separation structure 128, then the air enters the filter 106 through the opening 134, and the air is filtered by the filter 106 which separates air from a small amount of dust, such that the exhausted air is effectively purified. Specifically, when a robot vacuum cleaner 1000 operates, a vacuum is formed within the machine, and the dust is sucked into the box body 102 through the air inlet 130 due to an internal and external pressure difference. After the dust entrained in the air enters the box body 102, most of the dust, especially larger particles of dust are blocked by the separation structure 128 and falls to the bottom of the box body 102. Only a small amount of fine dust can pass through the opening 134 to the filter 106 along with the air. At this time, the dust is filtered by the filter 106, the air and the dust are effectively separated, and the exhausted air is effectively purified. By doing so, it is possible to avoid secondary pollution caused by poor air quality discharged from the dust collection box 100. In FIG. 9, a straight line with an arrow in the dust collection box 100 indicates air flow. The separation structure 128 is located at the air inlet side of the opening 134, that is, the separation structure 128 can be located anywhere before the air flow enters the opening 134. In other words, with respect to the separation structure 128, the opening 134 is located downstream of the air flow direction in the dust collection box 100. In such a way, it can be ensured that the air encounters the separation structure 128 before entering the opening 134.

In addition, only a small amount of dust can reach the filter 106, so the service life of the filter 106 is prolonged, and the user does not need to change or clean the filter 106 frequently, which brings about great convenience.

In this embodiment, the separation structure 128 is a bottom inclined surface 142 of the filter holder 126.

It could be understood that the separation structure 128 is the bottom inclined surface 142 of the filter holder 126, that is, the separation structure 128 is an integral part of the filter holder 126, which avoids occupying too much space of the box body 102. The separation structure 128 may be an inclined surface 142 facing the bottom of the box body 102, and the inclined surface 142 is opposite to the air inlet 130 and has a guiding effect on the air flow entrained with dust—making the dust fall to the bottom of the box body 102. Certainly, the separation structure 128 may not be an integral part of the filter holder 126, and the separation structure 128 may be provided in other places within the box body 102. The separation structure 128 may be a structural member having a guiding surface such as the inclined surface 142, a spherical surface, an aspheric surface, or the like.

In this embodiment, the filter 106 includes any one or more of a high efficiency particulate air (HEPA) filter, a filter sponge, and an activated carbon filter.

It could be understood that all of the HEPA filter, the filter sponge, and the activated carbon filter can be used to filter out dust. The filter 106 may be the HEPA filter, the filter sponge, or the activated carbon filter. Certainly, the filter 106 may be a combination of the HEPA filter and the filter sponge, a combination of the HEPA filter and the activated carbon filter, or a combination of the filter sponge and the activated carbon filter. The filter 106 may also be a combination of the HEPA filter, the filter sponge, and the activated carbon filter. One filter 106 or a plurality of filters 106 can be provided, which is determined in the light of filtration requirements.

Referring to FIGS. 11-15, in some embodiments, the filter holder 126 includes a bottom plate 136 and a lateral plate 138. The lateral plate 138 is connected to the bottom plate 136 and defines an accommodating space 140 along with the bottom plate 136. The filter 106 is at least partially located in the accommodating space 140. The bottom plate 136 includes the inclined surface 142 opposite to the air inlet 130. The inclined surface 142 forms the separation structure 128, and the air inlet side of the opening 134 faces away from the air inlet 130.

It could be understood that, the fact that the inclined surface 142 opposite to the air inlet 130 forms the separation structure 128 is advantageous for the separation structure 128 to block most of the dust entering the box body 102 along with the air, and at the same time, reduces the structural parts inside the dust collection box 100 to maximize a space for dust collection within the dust collection box 100. The air inlet side of the opening 134 faces away from the air inlet 130, and the separation structure 128 is located at the air inlet side of the opening 134. As a result, the opening 134 is away from the air inlet 130 as far as possible. The air flow entrained with dust passes through the separation structure 128 which blocks most of the dust, and then passes through the filter 106 via the opening 134, such that the filter 106 separates the air from a small amount of dust, whereby the air is further separated from the dust effectively and the exhausted air is further purified effectively.

In this embodiment, the filter 106 is substantially located in the accommodating space 140, that is, a top surface of the filter 106 is flush with a top surface of the filter holder 126, such that the overall thickness of the filter 106 and the filter holder 126 can be reduced, and the dust collection space in the dust collection box 100 can be guaranteed while the miniaturization of the dust collection box 100 is also achieved. In other embodiments, the filter 106 is partially located in the accommodating space 140, that is, the filter 106 can protrude relative to the top surface of the filter holder 126, in which embodiments, the depth of the accommodating space 140 may be designed to be relatively small, or a protruding portion of the filter 106 can also be used to position other components which are mounted on the filter 106 or the filter holder 126.

It could be understood that in order to guarantee a filtration effect, when the filter 106 is accommodated in the accommodating space 140, the filter 106 is allowed to have certain deformation to make the filter 106 be better secured to the filter holder 126. Certainly, the filter 106 can also be secured to the filter holder 126 using an auxiliary connector such as a fastener, a screw, and the like.

In this embodiment, the filter holder 126 includes a support plate 144. The support plate 144 is located in the accommodating space 140 and connected to the bottom plate 136 and the lateral plate 138, and the filter 106 is supported on the support plate 144.

As a result, the support plate 144 supports the filter 106, such that the filter 106 is relatively stable and less prone to offset when arranged on the filter holder 126, and more effectively filters the air flow passing through the opening 134, so as to effectively separate dust and air.

In this embodiment, a plurality of support plates 144 are provided, and the plurality of support plates 144 are spaced apart and arranged in the accommodating space 140, such that the filter 106 can be more effectively supported, and the filter 106 is prevented from being displaced due to uneven forces, which may affect the filtration effect otherwise.

In this embodiment, referring to FIGS. 9 and 10, the air inlet 130 and the air outlet 132 are provided in the same lateral surface of the box body 102, and the air inlet 130 is located below the air outlet 132.

As a result, when the robot vacuum cleaner 1000 operates, an air flow is formed between the air inlet 130 and the air outlet 132. The dust enters the box body 102 from the air inlet 130 along with the air flow. After filtration, the dust is blocked from flowing to the air outlet 132 and instead remains in the box body 102. The filtered air is discharged through the air outlet 132. Certainly, the air inlet 130 and the air outlet 132 may be provided in different lateral surfaces of the box body 102. When the air inlet 130 and the air outlet 132 are provided in the same lateral surface of the box body 102, the air outlet 132 may be located below the air inlet 130.

Figure 16:
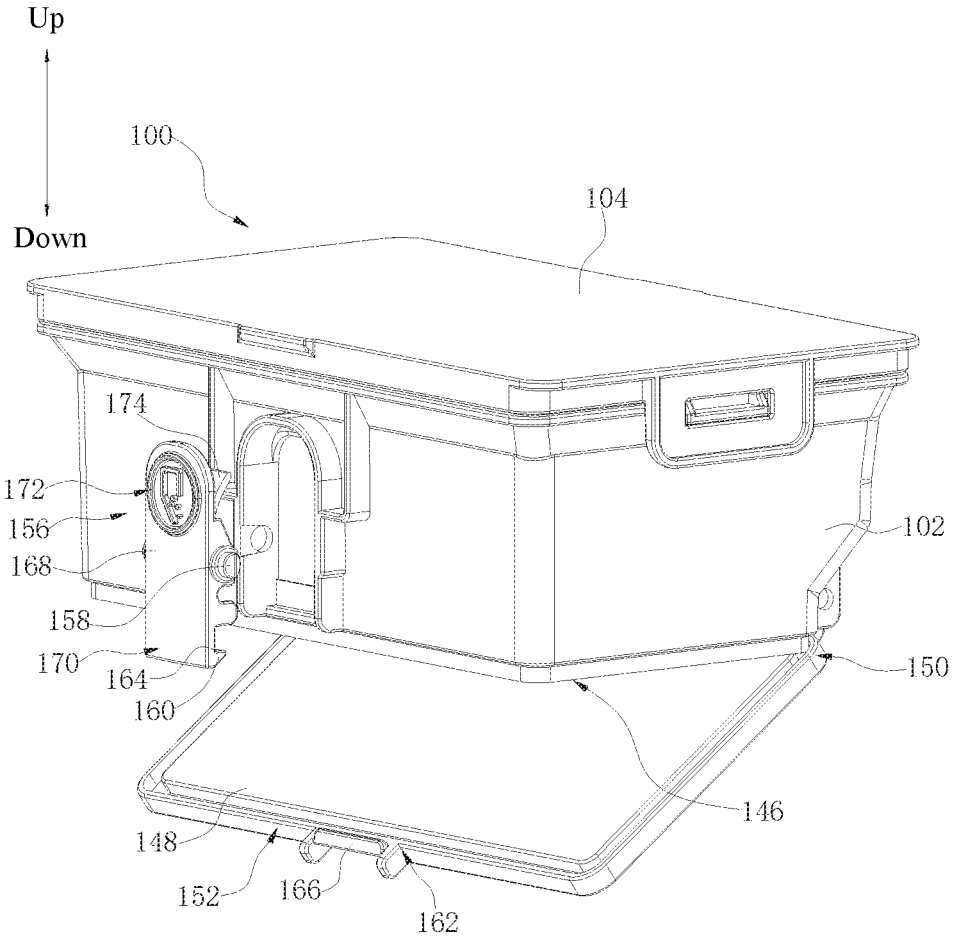
FIG. 16 is a partial exploded view of a dust collection box according to an embodiment of the present disclosure.

Referring to FIG. 16, in some embodiments, the bottom of the box body 102 defines a dust extraction port 146. The dust collection box 100 includes a second lid 148, and the second lid 148 is rotatably connected to the box body 102 and is used to open or close the dust extraction port 146.

It could be understood that by the second lid 148 opening or closing the dust extraction port 146 in the bottom of the box body 102, the dust can be conveniently removed from the box body 102.

In some embodiments, the second lid 148 includes a first lateral portion 150 and a second lateral portion 152 opposite to each other. The first lateral portion 150 is rotatably connected with the box body 102. When the second lid 148 closes the dust extraction port 146, the second lateral portion 152 is snap-fitted with the box body 102 through a snap structure 154.

It could be understood that, the snap structure 154 makes it convenient for the second lid 148 to open or close the dust extraction port 146. When the second lid 148 closes the dust extraction port 146, the second lateral portion 152 can be snap-fitted with the box body 102 more reliably through the snap structure 154. Specifically, during the removal of the dust from the robot vacuum cleaner 1000, the dust collection box 100 is first taken out from the robot vacuum cleaner 1000, and then the snap-fit relationship between the second lid 148 and the box body 102 is released, such that the second lid 148 can rotate to open the dust extraction port 146 and hence the dust carried by the second lid 148 flows out of the box body 102 along with the rotation of the second lid 148. In such a way, it is unnecessary to take out the filter 106 and the filter holder 126 from the box body 102 during the dust removal, which facilitates the cleaning process.

Further, the first lateral portion 150 can be rotatably connected to the box body 102 in the following manner. For example, the first lateral portion 150 is provided with a rotating shaft, the box body 102 is provided with a rotating hole, and the rotating shaft is received in the rotating hole to realize the rotatable connection between the first lateral portion 150 and the box body 102.

It should be noted that a bottom direction is a downward direction illustrated in the drawings, and a top direction is an upward direction illustrated in the drawings.

In some embodiments, the dust collection box 100 includes a button 156. The button 156 includes a second rotating shaft 158, and the button 156 is rotatably arranged to the box body 102 through the second rotating shaft 158. The snap structure 154 includes a hook 160 formed at an end of the button 156 and a snapping part 162 formed at the second lateral portion 152. The button 156 is swingable between a first position and a second position with respect to the box body 102. In the first position, the hook 160 is snap-fitted with the snapping part 162 to make the second lid 148 close the dust extraction port 146. In the second position, the hook 160 is disengaged from the snapping part 162 to make the second lid 148 open the dust extraction port 146.

Thus, after the button 156 is pressed down, the hook 160 is disengaged from the snapping part 162 to make the second lid 148 rotate to open the dust extraction port 146 to discharge the dust, which is a simple dust exhaust manner. Specifically, the hook 160 includes a snapping surface 164 facing upwards, the snapping part 162 includes a snapping bar 166, and in the first position, the snapping bar 166 abuts against the snapping surface 164, as illustrated in FIG. 9.

In this embodiment, the button 156 includes a press board 168, and the second rotating shaft 158 is fixed in a middle position of the press board 168. The press board 168 includes a first swing end 170 and a second swing end 172 located at two opposite sides of the second rotating shaft 158 respectively. The hook 160 forms the first swing end 170, the first swing end 170 swings towards a direction away from the box body 102, and the second swing end 172 swings towards a direction approaching the box body 102. The box body 102 defines a void space available for the second swing end 172 to swing. When the first swing end 170 swings away from the box body 102, the hook 160 is disengaged from the snapping bar 166 and hence the second lid 148 is opened.

As a result, the void space can prevent the button 156 from interfering with the box body 102 during the rotation.

In addition, a surface of the press board 168 opposite to the box body 102 is provided with a second elastic member 174. In a normal state, the second elastic member 174 may be or may not be in contact with a surface of the box body 102. When in contact, the second elastic member 174 may or may not generate an elastic force. When the elastic force is generated, the elastic force drives the second swing end 172 away from the box body 102. In such a way, the snap-fitting between the hook 160 and the second lid 148 is tightly fastened.

When the second swing end 172 is pressed towards the box body 102 by an external force, the second elastic member 174 is compressed, and the first swing end 170 swings away from the box body 102, such that the hook 160 is disengaged from the snapping bar 166, and the second lid 148 is opened. When the external force is revoked, the second elastic member 174 drives the second swing end 172 to swing away from the box body 102, such that the first swing end 170 is restored.

In this embodiment, the second elastic member 174 is an elastic plate on the press board 168. In other embodiments, the second elastic member 174 can be a spring, an elastic block or other elastic members.

In some embodiments, the dust collection box 100 includes a sealing member 176, and the sealing member 176 is arranged at a joint of the components of the dust collection box 100.

It could be understood that the joint of the components in the dust collection box 100 is poorly airtight, and the sealing member 176 is provided at the joint of the components to ensure the airtightness of the dust collection box 100, so as to facilitate the vacuuming of the robot vacuum cleaner 1000. The sealing member 176 can be a seal ring or a seal strip. Specifically, in the embodiments of the present disclosure, one seal ring is provided between the first lid 104 and the top of the box body 102, one seal ring is provided between the filter holder 126 and an inner wall of the box body 102, and one ring is provided between the second lid 148 and the bottom of the box body 102.

Figure 17:
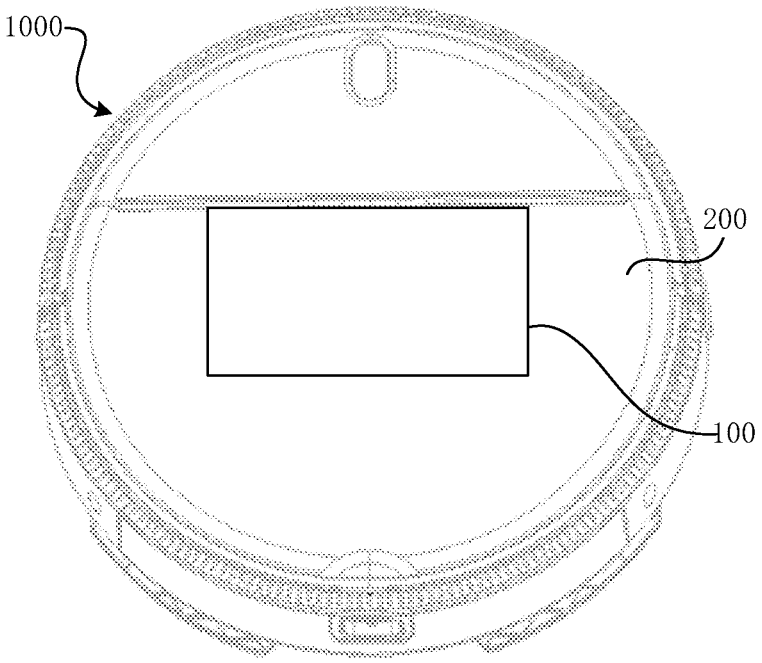
FIG. 17 is a schematic view of a robot vacuum cleaner according to an embodiment of the present disclosure.

Referring to FIG. 17, the robot vacuum cleaner 1000 according to embodiments of the present disclosure includes a robot body 200 and the dust collection box 100 according to any one of the above embodiments, and the dust collection box 100 is arranged to the robot body 200.

For the robot vacuum cleaner 1000 according to embodiments of the present disclosure, when the filter 106 is not mounted in the box body 102, the box body 102 cannot be closed with the first lid 104 by using the filter missing-alert device 108. In this way, it is possible to effectively prevent the user from forgetting to assemble the filter 106, hence prevent the air from being discharged without filtration, and also prevent the dust from affecting the service life of the electric motor.

Preferably, the dust collection box 100 is detachably arranged to the robot body 200, for example, through a snap, a screw, an adhesive or the like.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings are described above. However, these elements and settings are only by way of example and are not intended to limit the present disclosure. In addition, reference numerals and/or reference letters may be repeated in different examples in the present disclosure. This repetition is for the purpose of simplification and clarity, and does not refer to relations between different embodiments and/or settings. Furthermore, examples of different processes and materials are provided in the present disclosure. However, it would be appreciated by those skilled in the art that other processes and/or materials may be also applied.

Reference throughout this specification to "an embodiment," "some embodiments," "an exemplary embodiment," "an example," "specific examples" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments have been shown and illustrated, it shall be understood by those skilled in the art that various changes, modifications, alternatives and variations without departing from the principle of the present disclosure are acceptable. The scope of the present disclosure is defined by the claims or the like.

What is claimed is:

1. A dust collection box, comprising: a box body, a first lid detachably arranged to the box body, a filter, and a filter missing-alert device arranged to the first lid, the filter missing-alert device comprising a movable member;

wherein a bottom of the box body defines a dust extraction port, and the dust collection box comprises a second lid, the second lid being rotatably connected to the box body and configured for opening or closing the dust extraction port;

wherein the movable member is configured such that:

when the filter is not mounted into the box body and the first lid is arranged to be closed onto the box body, the movable member interferes with the box body to prevent the box body from being closed with the first lid; and when the filter is mounted into the box body and the first lid is arranged to be closed onto the box body, the interference between the movable member and the box body is eliminated due to the filter missing-alert device interfering with the filter, and box body thereby is closed with the first lid;

wherein the filter missing-alert device comprises a rotating part rotatably connected with the first lid, and the rotating part comprises the movable member and a driving member; and, wherein when the filter is not mounted into the box body and the first lid is arranged to be closed onto the box body, a tail end of the driving member is suspended and stretches into the box body;

when the filter is mounted into the box body and the first lid is arranged to be closed onto the box body, the tail end of the driving member interferences with the filter to cause the driving member to drive the rotating part to rotate to eliminate the interference between the movable member and the box body.

2. The dust collection box according to claim 1, wherein the rotating part comprises a connecting part, the driving member and the movable member are connected at two sides of the connecting part, and the connecting part is rotatably connected with the first lid.

3. The dust collection box according to claim 2, wherein a bottom surface of the first lid is provided with a mounting structure, the mounting structure is provided with a mounting hole, the connecting part comprises a first rotating shaft, and the first rotating shaft is rotatably arranged in the mounting hole.

4. The dust collection box according to claim 1, wherein the filter missing-alert device comprises a first elastic member, the first elastic member abuts the first lid and the rotating part, and the first elastic member is configured to drive the movable member to rotate when the driving member interferes with the filter to eliminate the interference between the movable member and the box body.

5. The dust collection box according to claim 1, wherein the dust collection box comprises a filter holder arranged within the box body and a separation structure configured to block dust; and, wherein the box body defines an air inlet and an air outlet;

a lateral surface of the filter holder defines an opening;

the separation structure is arranged within the box body and located at an air inlet side of the opening; and when the filter is arranged in the box body, the filter is arranged on the filter holder and located at an air outlet side of the opening.

6. The dust collection box according to claim 5, wherein the filter holder comprises a bottom plate and a lateral plate;

the lateral plate is connected to the bottom plate and defines an accommodating space along with the bottom plate;

the filter is at least partially located in the accommodating space;

the bottom plate comprises an inclined surface opposite to the air inlet; and the inclined surface forms the separation structure; and the air inlet side of the opening faces away from the air inlet.

7. The dust collection box according to claim 1, wherein the second lid comprises a first lateral portion and a second lateral portion opposite to each other, wherein the first lateral portion is rotatably connected with the box body, and when the second lid closes the dust extraction port, the second lateral portion is snap-fitted with the box body through a snap structure.

8. The dust collection box according to claim 7, wherein the dust collection box comprises a button, wherein the button comprises a second rotating shaft, and the button is rotatably arranged to the box body through the second rotating shaft;

the snap structure comprises a hook formed at an end of the button and a snapping part formed at the second lateral portion; and the button is swingable, with respect to the box body, between a first position where the hook is snap-fitted with the snapping part to make the second lid close the dust extraction port and a second position where the hook is disengaged from the snapping part to make the second lid open the dust extraction port.

9. A robot vacuum cleaner, comprising:

a robot body; and a dust collection box, arranged to the robot body, and comprising a box body, a first lid detachably arranged to the box body, a filter, and a filter missing-alert device arranged to the first lid, the filter missing-alert device comprising a movable member;

wherein a bottom of the box body defines a dust extraction port, and the dust collection box comprises a second lid, the second lid being rotatably connected to the box body and configured for opening or closing the dust extraction port;

wherein the movable member is configured such that:

when the filter is not mounted into the box body and the first lid is arranged to be closed onto the box body, the movable member interferes with the box body to prevent the box body from being closed with the first lid; and when the filter is mounted into the box body and the first lid is arranged to be closed onto the box body, the interference between the movable member and the box body is eliminated due to the filter missing-alert device interfering with the filter, and box body thereby is closed with the first lid;

wherein the filter missing-alert device comprises a rotating part rotatably connected with the first lid, and the rotating part comprises the movable member and a driving member; and, wherein when the filter is not mounted into the box body and the first lid is arranged to be closed onto the box body, a tail end of the driving member is suspended and stretches into the box body;

when the filter is mounted into the box body and the first lid is arranged to be closed onto the box body, the tail end of the driving member interferences with the filter to cause the driving member to drive the rotating part to rotate to eliminate the interference between the movable member and the box body.

10. The robot vacuum cleaner according to claim 9, wherein the rotating part comprises a connecting part, the driving member and the movable member are connected at two sides of the connecting part, and the connecting part is rotatably connected with the first lid.

11. The robot vacuum cleaner according to claim 10, wherein a bottom surface of the first lid is provided with a mounting structure, the mounting structure is provided with a mounting hole, the connecting part comprises a first rotating shaft, and the first rotating shaft is rotatably arranged in the mounting hole.

12. The robot vacuum cleaner according to claim 9, wherein the filter missing-alert device comprises a first elastic member, the first elastic member abuts the first lid and the rotating part, and the first elastic member is configured to drive the movable member to rotate when the driving member interferes with the filter to eliminate the interference between the movable member and the box body.

13. The robot vacuum cleaner according to claim 9, wherein the dust collection box comprises a filter holder arranged within the box body and a separation structure configured to block dust; and, wherein the box body defines an air inlet and an air outlet;

a lateral surface of the filter holder defines an opening;

the separation structure is arranged within the box body and located at an air inlet side of the opening; and when the filter is arranged in the box body, the filter is arranged on the filter holder and located at an air outlet side of the opening.

14. The robot vacuum cleaner according to claim 13, wherein the filter holder comprises a bottom plate and a lateral plate;

the lateral plate is connected to the bottom plate and defines an accommodating space along with the bottom plate;

the filter is at least partially located in the accommodating space;

the bottom plate comprises an inclined surface opposite to the air inlet; and the inclined surface forms the separation structure; and the air inlet side of the opening faces away from the air inlet.

15. The robot vacuum cleaner according to claim 9, wherein the second lid comprises a first lateral portion and a second lateral portion opposite to each other, wherein the first lateral portion is rotatably connected with the box body, and when the second lid closes the dust extraction port, the second lateral portion is snap-fitted with the box body through a snap structure;

the dust collection box comprises a button, wherein the button comprises a second rotating shaft, and the button is rotatably arranged to the box body through the second rotating shaft;

the snap structure comprises a hook formed at an end of the button and a snapping part formed at the second lateral portion; and the button is swingable, with respect to the box body, between a first position where the hook is snap-fitted with the snapping part to make the second lid close the dust extraction port and a second position where the hook is disengaged from the snapping part to make the second lid open the dust extraction port.

16. A robot vacuum cleaner, comprising:

a robot body; and a dust collection box, arranged to the robot body, and comprising a box body, a first lid detachably arranged to the box body, a filter, and a filter missing-alert device arranged to the first lid, the filter missing-alert device comprising a movable member; and, wherein a bottom surface of the first lid is provided with a mounting structure, the mounting structure is provided with a mounting hole, the connecting part comprises a first rotating shaft, and the first rotating shaft is rotatably arranged in the mounting hole the filter missing-alert device comprises a rotating part rotatably connected with the first lid, and the rotating part comprises the movable member and a driving member, and a connecting part, the driving member and the movable member are connected at two sides of the connecting part, and the connecting part is rotatably connected with the first lid;

when the filter is not mounted into the box body and the first lid is arranged to be closed onto the box body, a tail end of the driving member is suspended and stretches into the box body to prevent the box body from being closed with the first lid; and when the filter is mounted into the box body and the first lid is arranged to be closed onto the box body, the tail end of the driving member interferences with the filter to cause the driving member to drive the rotating part to rotate to eliminate the interference between the movable member and the box body.

* * * * *